US005184853A

United States Patent [19]

Whatley

[11] Patent Number: 5,184,853

[45] Date of Patent: Feb. 9, 1993

[54] TOOL OPERABLE DOOR LOCK MECHANISM

[75] Inventor: Richard F. Whatley, Suwanee, Ga.

[73] Assignee: Northern Telecom Limited, Montreal, Canada

[21] Appl. No.: 907,020

[22] Filed: Jul. 1, 1992

[51] Int. Cl.[5] ..... E05C 3/04

[52] U.S. Cl. ..... 292/205; 292/210; 292/DIG. 60; 292/DIG. 61

[58] Field of Search ..... 292/104, 108, 205, 210, 292/DIG. 60, DIG. 61

[56] References Cited

U.S. PATENT DOCUMENTS

| | | | |
|---|---|---|---|
| 1,153,514 | 9/1915 | North et al. | 292/210 |
| 1,680,564 | 8/1928 | Moore | 292/DIG. 61 X |
| 5,015,019 | 5/1991 | Razdolsky | 292/210 X |

OTHER PUBLICATIONS

Eberhard Manufacturing Co., "Dead Bolt Latches", Section 4, pp. 1 and 29, 1988.

*Primary Examiner*—Richard E. Moore

*Attorney, Agent, or Firm*—Foley & Lardner

[57] ABSTRACT

A door lock mechanism that allows either tool operable locking or padlocking of a handle and escutcheon assembly. The lock includes a tool operable insert inset in the lock base and adapted to receive any one of number of standard tools. Such tools are used in industry to restrict access to specific groups of craft persons. For applications desiring padlock capability, the tool operable access can be disabled. A pawl coupled to the tool operable insert, is operable between first and second positions. When the pawl is biassed toward the first position, corresponding to the locked state, it will engage the latch, thereby effecting locking, whenever the latch is brought to the latched position, by turning the handle to a vertical position, and the use of the tool operable insert is enabled for disengaging the pawl from the latch and the pawl. When the pawl is biassed toward the second position the pawl is prevented from engaging the latch, thus disabling the tool operable lock to provide for padlocking. The escutcheon and the handle have openings aligned with each other when the latch is in the latched position for the use of a padlock.

12 Claims, 4 Drawing Sheets

TOOL OPERABLE DOOR LOCK MECHANISM

This invention relates to door lock mechanism and is particularly concerned with tool operable locks for equipment cabinets.

BACKGROUND OF THE INVENTION

In the industrial sector there are in use many types of cabinets and enclosures which use tool operable locking mechanisms. Examples of industrial uses for such cabinets are, electrical, heating and air conditioning, cable television and telephone. Craft persons requiring access to a particular piece of equipment unlock the cabinet with standard tools issued within their respective industries. In this way, problems of key access and duplication thereof can be avoided, while still preventing unauthorized entry. Within some industries, for example the telephone industry, there are two or more special tools which are used to segregate the crafts persons in accordance with their access privileges. Not all companies within a particular sector of industry desire tool operable locks, preferring padlocks. Thus, a mechanism which is able to be locked either by a tool operable latch or padlock in a cost effective manner would be desirable.

SUMMARY OF THE INVENTION

An object of the present invention is to provide an improved tool operable door lock mechanism.

In accordance with one aspect of the present invention there is provided a door lock mechanism, comprising base means for fixedly attaching the door lock mechanism to a door panel, latch means abutting the base means and pivotal between first and second positions, the first position corresponding to a latched state of the door lock mechanism, handle means abutting the base means and engaging the latch means for operation thereof, tool operable means rotatively coupled to the base means and adapted to receive a predetermined tool, pawl means coupled to the tool operable means, operable between first and second positions, and means for biassing the pawl toward one of the first or second positions, the first position corresponding to a locked state in which the pawl means engages the latch means in its first position, whereby biassing toward the first position enables the use of the tool operable means for disengaging the pawl means from the latch means and whereby biassing towards the second position prevents the pawl means from engaging the latch means thereby disabling the tool operable means.

In an embodiment of the present invention, the base means includes a lock base on one side of the door panel and a escutcheon on the other side. Conveniently, the escutcheon and handle are a commercially available preassembled cabinet exterior door handle assembly, which is able to be padlocked, with which the lock base is integrated.

Conveniently, the first position of the latch corresponds to a central, substantially vertical, handle position. While the second position of the latch corresponds to a handle position turned either fully right or left of the central handle position.

In accordance with another aspect of the present invention there is provided a door lock mechanism comprising a base, for fixedly attaching the door lock mechanism to a door panel, having first and second openings, a latch having a face and a projection from the face, the face abutting the base, and the projection engaging the first opening thereby allowing the latch to pivot between first and second positions, the first position corresponding to a latched state of the door lock mechanism, a handle engaging the latch for operation thereof, a tool operable insert rotatively coupled in the second opening of the base and adapted to receive a predetermined tool, a pawl coupled to the tool operable insert, operable between first or second positions; and means for biassing the pawl toward one of the first and second positions, the first position corresponding to a locked state in which the pawl means engages the latch in its first position, whereby biassing toward the first position enables the use of the tool operable insert for disengaging the pawl from the latch and whereby biassing towards the second position prevents the pawl from engaging the latch thereby disabling the tool operable means.

Preferably, the base is symmetrical about its vertical axis and the means for biassing the pawl includes two pins fixedly attached to the base substantially equidistant from the second opening in the base and a spring engaging the pawl at one end and one of the pins at the other.

Advantages of the present invention are: the ability to integrate varying tool operable lock operations into a single handle/latch design; the provision of a locking operation which is self activating when the handle is returned to the neutral position (when the pawl is biassed to enable locking); providing a locking operation that can be disabled when a padlock is preferred; and the ability to be assembled for either right or left hand door applications, thus allowing a variety of customers and cabinets to use the same cabinet lock mechanism.

BRIEF DESCRIPTION OF THE DRAWINGS

The present invention will be further understood from the following description with reference to the drawings in which:

FIG. 5, in a front elevation, illustrates the locked and unlocked positions of the interior of the door lock mechanism of FIG. 1.

Similar references are used in different figures to denote similar components.

DETAILED DESCRIPTION

Figure 1:
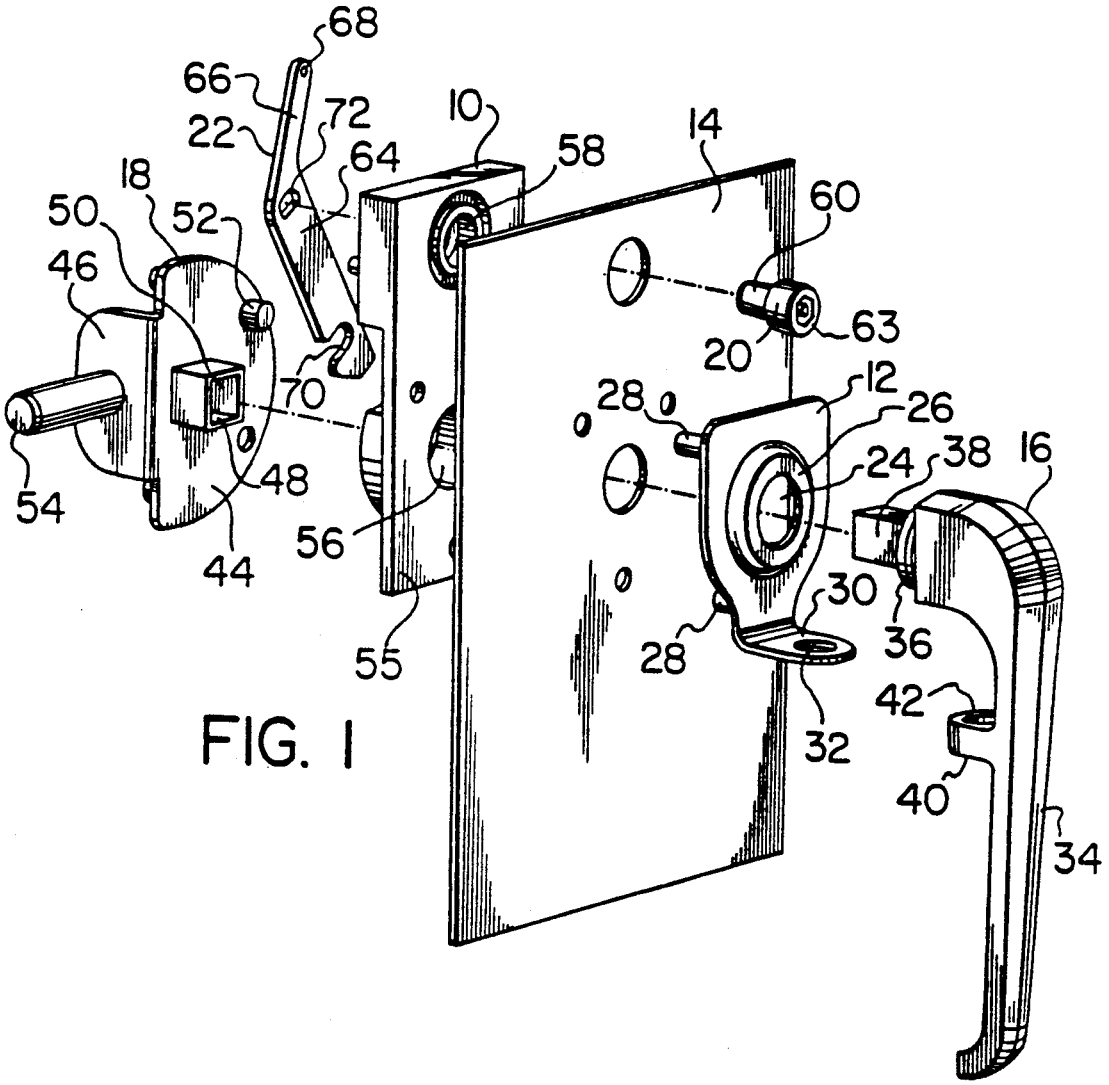
FIG. 1, in an expanded perspective view, illustrates a door lock mechanism in accordance with an embodiment of the present invention.

Referring to FIG. 1, there is illustrated in an expanded perspective view, a door lock mechanism in accordance with an embodiment of the present invention. The door lock mechanism includes a lock base 10 and a escutcheon 12, which in assembly, are through bolted together on opposite sides of a door panel 14 (shown as a rectangular portion in FIG. 1), a handle 16 and a latch 18, received by the escutcheon 12 and lock base 10 respectively, the handle 16 engaging the latch 18 for actuation thereof, and a tool operable insert 20 and a pawl 22 receiving the insert 20 for activation thereof.

The escutcheon 12 has an opening 24 through its face 26 for receiving handle 16. The escutcheon 12 has three posts 28 (two of which are visible in FIG. 1), internally threaded to receive through bolts for mounting the lock base 10 and the escutcheon 12 to the door panel 14. The escutcheon 12 has, at its lower edge, a struck up portion 30 with an aperture 32.

The handle 16 has a down-turned portion 34 and a cylindrical shaft 36. The cylindrical shaft 36 has an end portion 38 of square cross-section for engaging the latch 18. The down-turned portion 34 of handle 16 has a struck up member 40 with an aperture 42 of similar size to the aperture 32 in the struck up portion 30 of escutcheon 12. Both apertures 32 and 42 are aligned when the handle is in a substantially vertical position which corresponds to a latched position for the latch 18 and are sized to receive a shackle of a padlock (not shown in FIG. 1).

The latch 18 has a first face 44, for abutting the lock base 10, and a second face 46, substantially perpendicular to the first face. Approximately centered on the first face 44, there is a projection 48 of square cross-section. The projection 48 has a recess 50 in its outer face. The recess 50 is sized to receive the end portion 38 of the handle shaft 36. The first face 44 also has a pin 52, projecting therefrom and located near its edge, for engagement with the pawl 22 for providing the lock position of the latch 18. The pin 52 is located on as large a radius as space will permit and is sized to withstand any torque which might be applied expected during an attempted forced entry. The second face 46 has projecting therefrom a post 54 for engaging a cabinet frame (not shown in FIG. 1), in the latched position.

The lock base 10 is a rectangular block with a major face 55 for abutting the door panel 14. The major face 55 has, on its vertical axis, a first opening 56 therethrough for receiving the projection 48 of latch 18. The lock base has a second opening 58, also through its major face 55, on its vertical axis and above the first opening 56, for receiving the insert 20. The insert 20 is cylindrical and has a shaft 60 of reduced diameter with a D-shaped end portion 62 for engaging the pawl 22. The interior end of the insert 20 is machined to retain the pawl 22 by means such as a groove and retaining ring. Thus, the insert 20 and the pawl 22 are captured by the lock base 10. The exterior end of insert 20 has a recess 63 for accepting a standardized unlocking tool. For example, in the telephone industry the tools can be an AT&T 5/16 in. socket head cap screw with tamper proof ⅛ in. diameter pin or an AT&T 216 tool having a 7/16 in. external hex. The interior side of the insert 20 (not shown completely in FIG. 1) can have a grove for a retaining clip, thereby allowing field fitting of inserts to change crafts person access to a particular cabinet.

The pawl 22 is a flat elongate bar 64 having at a first end an obtusely angled arm 66. The remote end of the arm 66 has an opening 68 for receiving a biassing spring (not shown in FIG. 1). At the other end of the bar 64, on the side opposite the arm 66, there is a u-shaped opening 70 for engaging the pin 52, in the locked position. Adjacent the first end of bar 64 there is a D-shaped opening 72, sized to receive the D-shaped end portion 62 of insert 20.

Figure 2:
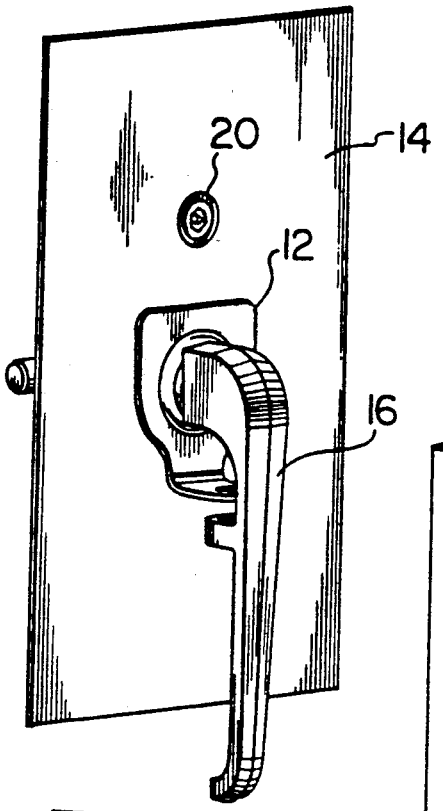
FIG. 2, in a perspective exterior view, illustrates the door lock mechanism of FIG. 1.

A perspective exterior view is illustrated in FIG. 2. In an assembled state, the exterior view shows the escutcheon 12, the handle 16 and the insert 20 mounted on the door panel 14 (a portion of post 54 is visible merely because of the partial section of the door panel 14). The insert 20 is recessed within the cabinet to provide protection against vandalism. The latch mechanism allows the handle to be turned either to the left or the right, thereby eliminating any need for labelling on the outside of the cabinet.

Figure 3:
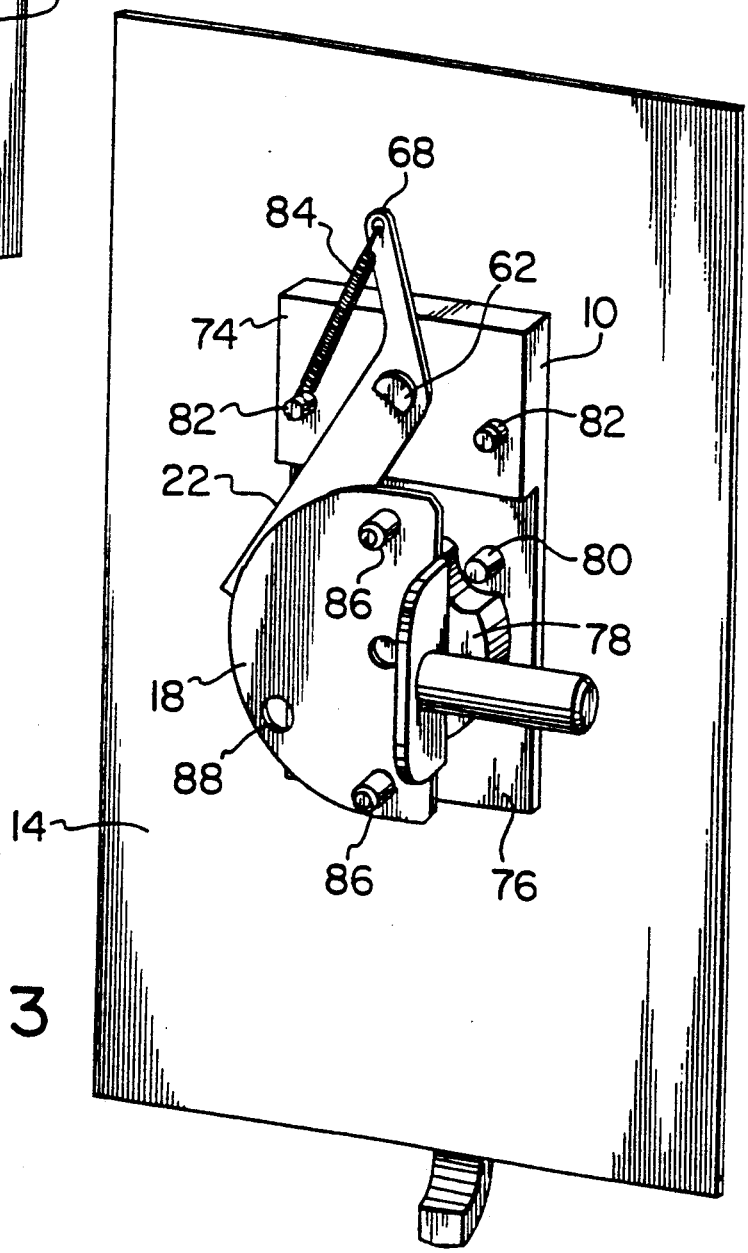
FIG. 3, in a perspective interior view, illustrates the door lock mechanism of FIG. 1.

In FIG. 3, the door lock mechanism of FIG. 1 is illustrated in a perspective interior view. This view shows detail either not shown in FIG. 1 or only partially shown. In an assembled state, the interior view shows the lock base 10 abutting the door panel 14, the latch 18 and the pawl 22 (a portion of the handle 16 is visible merely because of the partial section of the door panel 14).

The lock base 10 has an inner face 74 substantially parallel to the major face 55. The inner face 74 has a relieved section 76 forming a substantially circular area 78 for abutting the first face 56 of the latch 18. The circular area 78 is sized to provide clearance for the pin 52 and the pawl 22. The circular area 78 is itself relieved for the heads of through bolts and the lock base 10 is bored for three openings 80 for receiving the through bolts used to fasten the lock base 10 and the escutcheon 12 to the door panel 14. The inner face 74 carries two pins 82 symmetrically spaced from the second opening 58 for receiving one end of a biassing spring 84. The other end of the spring 84 engages the pawl 22 through the opening 68. The pins also serve to restrict the movement of the pawl 22 thereby preventing over-rotation of the insert 20, and excessive elongation of the biassing spring 84.

The latch 18 is shown having two pins 86 attached to its inner face. The pins 86 are optional and can be used to attach closure rods (not shown in FIG. 3) to accommodate three-point latching. A opening 88 is shown at the outer edge of the latch 18 below a midline therethrough. The opening 88 provides an optional placement for the pin 52 for assembly of the door lock mechanism for use with a left-handed opening door.

Figure 4:
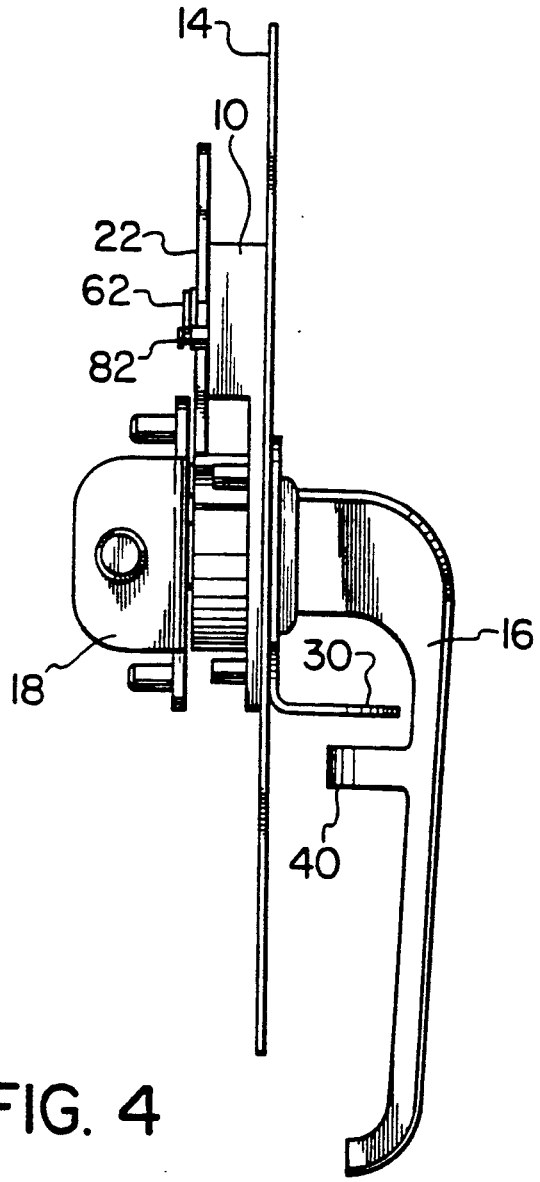
FIG. 4, in a side elevation, illustrates the door lock mechanism of FIG. 1.

In FIG. 4, the door lock mechanism of FIG. 1 is illustrated in a side elevation.

In operation, the door lock can be used in either a tool-operable manner or the tool-operable lock can be disabled to allow the use of a padlock. How this is achieved is explained hereinbelow in connection with FIG. 5. For convenience the following are defined: a latched position is effected by bringing the handle into a vertical position such that the latch engages the cabinet and a locked position is effected by the pawl engaging the latch when the latch is in the latched position.

Figure 5B:
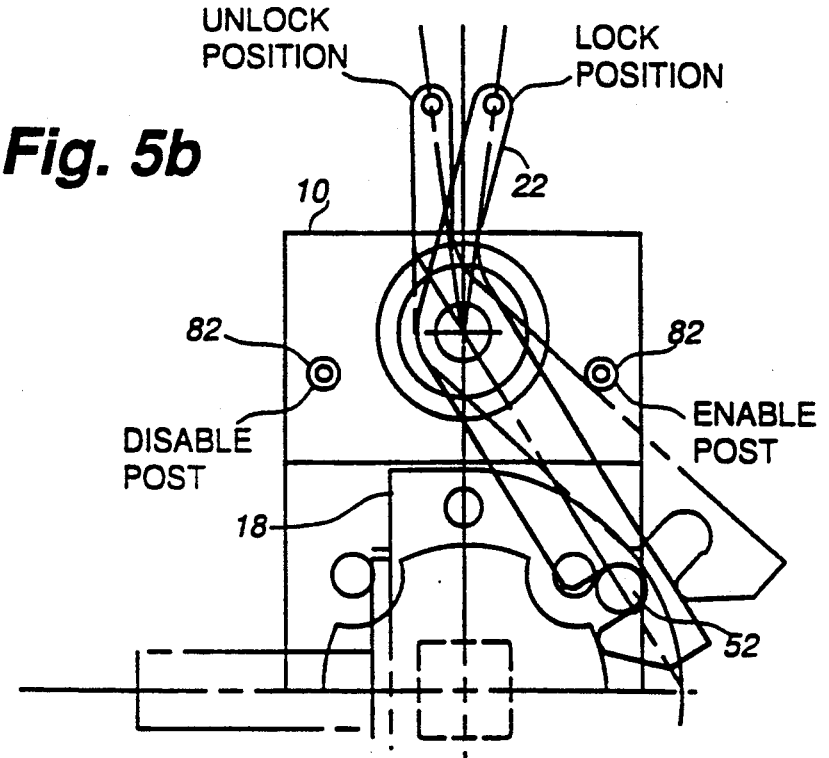
FIG. 5*b* illustrates the lock mechanism assembled for a left-hand opening door.
Figure 5A:
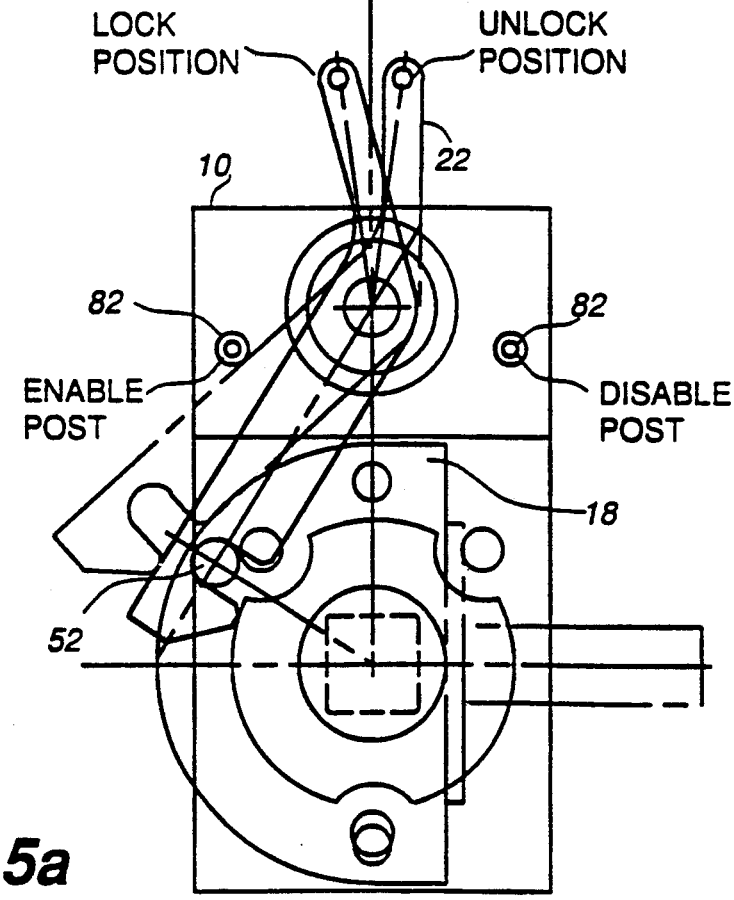
FIG. 5*a* illustrates the lock mechanism assembled for a right-hand opening door.

Referring to FIG. 5, in a front elevation, there is illustrated, the locked and unlocked positions of the interior of the door lock mechanism. FIG. 5*a* illustrates the lock mechanism assembled for a right-hand opening door, while FIG. 5*b* illustrates the lock mechanism assembled for a left-hand opening door. The pins 82 provide enable and disable positions for the spring 84 (not shown in FIG. 5). When the spring 84 engages the left post 82 in FIG. 5*a* or the right post 82 in FIG. 5*b*, the pawl is biassed against the pin 52 thereby providing automatic locking anytime the handle 16 is rotated from either direction to the vertical latching position at which time the u-shaped opening 70 engages the pin 52. Thus, the enable position of the spring allows the use of the tool operable insert 20 to unlock the latch 18. In the event that the cabinet is to be lock with a padlock, the spring 84 is moved to the disable position provided by the other of posts 82. When the spring 84 engages the right post 82 in FIG. 5*a* or the left post 82 in FIG. 5*b*, the pawl is biassed away from the pin 52 thereby disabling the tool-operated lock.

The lock base 10 can be machined or cast. The base 10 holds the insert 20 in a well recessed into the handle side of the lock base. An 0-ring groove may be added to the well to prevent rain water from leaking into the cabinet. The lock base 10 provides support to the handle 16 to help it resist deflection caused by side loads due to vandalism or attempts of forced entry. The lock base 10 is symmetrical about its vertical axis. The pawl 22 is designed such that the path of the obtuse arm 66 is bisected by the vertical axis of the base. This allows the enable/disable feature of the tool operable insert 20 and allows assembly with the pawl 22 on either of posts 82 for right and left hand opening doors.

Conveniently, the escutcheon 12 and the handle 16 are commercially available as an assembly.

The option of providing either padlock or tool operable lock capability allows a variety of customers to use the same cabinet lock mechanism.

Numerous modifications, variations and adaptations may be made to the particular embodiments of the invention described above without departing from the scope of the invention, which is defined in the claims.

What is claimed is:

1. A door lock mechanism, comprising:

base means for fixedly attaching the door lock mechanism to a door panel;

latch means abutting the base means and pivotal between first and second positions, the first position corresponding to a latched state of the door lock mechanism;

handle means abutting the base means and engaging the latch means for operation thereof;

tool operable means rotatively coupled to the base means and adapted to receive a predetermined tool;

pawl means coupled to the tool operable means, operable between first and second positions; and means for biassing the pawl toward one of the first and second positions, the first position corresponding to a locked state in which the pawl means engages the latch means in its first position, whereby biassing toward the first position enables the use of the tool operable means for disengaging the pawl means from the latch means and whereby biassing towards the second position prevents the pawl means from engaging the latch means thereby disabling the tool operable means.

2. A mechanism as claimed in claim 1 wherein the base means includes a lock base on one side of the door panel and an escutcheon on the other side.

3. A mechanism as claimed in claim 2 wherein the escutcheon includes a struck up portion having an opening and the handle means includes a handle with a corresponding struck up member having an opening, the openings being substantially aligned with each other when the latch is in its first position.

4. A mechanism as claimed in claim 3 wherein the first position of the latch corresponds to a central, substantially vertical, handle position.

5. A mechanism as claimed in claim 4 wherein the second position of the latch corresponds to a handle position turned either fully right or left of the central handle position.

6. A door lock mechanism, comprising:

a base, for fixedly attaching the door lock mechanism to a door panel, having first and second openings;

a latch having a face and a projection from the face, the face abutting the base, and the projection engaging the first opening thereby allowing the latch to pivot between first and second positions, the first position corresponding to a latched state of the door lock mechanism;

a handle engaging the latch for operation thereof;

a tool operable insert rotatively coupled in the second opening of the base and adapted to receive a predetermined tool;

a pawl coupled to the tool operable insert, operable between first and second positions; and means for biassing the pawl toward one of the first and second positions, the first position corresponding to a locked state in which the pawl means engages the latch in its first position, whereby biassing toward the first position enables the use of the tool operable insert for disengaging the pawl from the latch and whereby biassing towards the second position prevents the pawl from engaging the latch thereby disabling the tool operable means.

7. A mechanism as claimed in claim 6 wherein the base is symmetrical about its vertical axis.

8. A mechanism as claimed in claim 6 wherein the means for biassing the pawl includes two pins fixedly attached to the base substantially equidistant from the second opening in the base and a spring engaging the pawl at one end and one of the pins at the other.

9. A mechanism as claimed in claim 6 wherein the projection of the latch has a recess for receiving the handle.

10. A mechanism as claimed in claim 9 wherein the handle includes a shaft received by the first opening of the base, the shaft having a portion thereof shaped to engage the recess for activation of the latch.

11. A mechanism as claimed in claim 8 further comprising an escutcheon having an aperture for receiving the shaft of the handle.

12. A mechanism as claimed in claim 11 wherein the escutcheon includes a struck up portion having an opening and the handle includes a corresponding struck up member having an opening, the openings being substantially aligned with each other when the latch is in its first position.

* * * * *